US006029577A

United States Patent [19]

Fukuoka et al.

[11] Patent Number: 6,029,577

[45] Date of Patent: Feb. 29, 2000

[54] DAMPENING VOLUME CONTROL APPARATUS FOR OFFSET PRESS AND A METHOD FOR CONTROLLING DAMPENING VOLUME THEREFOR

[75] Inventors: Shigeki Fukuoka; Tetsuya Nakai, both of Fuchu, Japan

[73] Assignee: Ryobi Ltd., Hiroshima-ken, Japan

[21] Appl. No.: 09/034,252

[22] Filed: Mar. 4, 1998

[30] Foreign Application Priority Data

Mar. 6, 1997 [JP] Japan ..... 9-051417

[51] Int. Cl.[7] ..... B41F 7/06

[52] U.S. Cl. ..... 101/492; 101/148; 101/349.1; 73/1.73

[58] Field of Search ..... 101/492, 147, 101/148, 348, 349.1, 450.1, 451, 365; 73/1.73

[56] References Cited

U.S. PATENT DOCUMENTS

| | | | |
|---|---|---|---|
| 3,835,777 | 9/1974 | Krygeris | 101/365 |
| 4,660,470 | 4/1987 | Kramp et al. | 101/492 |
| 4,787,238 | 11/1988 | Seki et al. . | |
| 5,158,017 | 10/1992 | MacConnell et al. | 101/492 |
| 5,174,210 | 12/1992 | Rodi et al. | 101/492 |
| 5,447,102 | 9/1995 | Pfeiffer et al. | 101/492 |

FOREIGN PATENT DOCUMENTS

| | | |
|---|---|---|
| 47-4338 | 3/1972 | Japan . |
| 61-89047 | 5/1986 | Japan . |
| 62-75304 | 4/1987 | Japan . |
| 63-157004 | 6/1988 | Japan . |
| 4-83640 | 3/1992 | Japan . |

*Primary Examiner*—Eugene Eickholt
*Attorney, Agent, or Firm*—Merchant & Gould P.C.

[57] ABSTRACT

It is an object of the present invention to provide a dampening volume control apparatus capable of shortening a period of time for adjusting a desired value of characteristics. A switch SW1 is a switch for switching the apparatus either in an automatic control mode or a manual control mode. A dampening volume of the dampening solution being stored in a manual dampening volume storing means 21 is varied by adjusting a switch SW21 and/or a switch 22. Revolution speed of a motor 25 is controlled by a controller 23 in accordance with the dampening volume thus varied. The switch SW1 is turned to the automatic control mode when the operator judges that quality of printing done on the printed papers is qualified to the criteria. The revolution speed of the motor 25 is controlled so as to make the dampening volume on the plate surface coincide with the volume corresponding to the desired value during the automatic control condition.

6 Claims, 4 Drawing Sheets

<PRIOR ART>

<PRIOR ART>

DAMPENING VOLUME CONTROL APPARATUS FOR OFFSET PRESS AND A METHOD FOR CONTROLLING DAMPENING VOLUME THEREFOR

CROSS-REFERENCE TO RELATED APPLICATIONS

This application is based on Application No. Hei 9-51417 filed on Mar. 6, 1997 in Japan, the content of which is incorporated hereinto by reference.

BACKGROUND OF THE INVENTION

1. Field of the Invention

The present invention relates to a dampening volume control apparatus for offset press, more specifically, as to an apparatus for setting desired values of dampening volume.

2. Description of the Prior Art

In offset printing, phenomena so called scumming or similar problems that ink is oversupplied even to non-imaging areas of printing papers occurs when less amount of dampening solution relative to that of the ink is supplied to an offset plate. On the contrary, occurrence of emulsification including water streak and uneven density of printing are observed when too much amount of the dampening solution relative to that of the ink is supplied to the offset plate. So that, it is necessary to maintain the amount of both the ink and the dampening solution supplied to the offset plate within an appropriate range during printing work.

In order to prevent both the phenomena and the emulsification, a dampening volume control apparatus shown in FIG. 3 which keeps supply amount of the dampening solution in a certain volume is proposed (see Japanese laid-open publication No. Hei 4-83640). In the control apparatus, a desired value of the dampening volume (a supply amount of the dampening solution) is stored in a controller 123, then actual dampening volume of the dampening solution supplied to a plate 33 is detected by a dampening volume sensor 41. The detected volume of the dampening solution is compared with the stored value. Revolution speed of a motor 25 is controlled by the controller 123 in accordance with a result of the comparison. In this way, revolution speed of a water fountain roller 28 is varied. So that, feed-back control is carried out so as to make the dampening solution supplied to the plate 33 coincide with the desired value stored in the controller 123 as a result of varying the revolution speed of the water fountain roller 28.

However, the dampening volume control apparatus described earlier has following problems to be resolved. Quality of printing can be controlled by storing the desired value in the controller 123 when the desired value is determined as a certain value. Nevertheless, the desired value itself is varied by following factors such as room temperature, humidity at the room, material of the plate and others. Actually, the desired value is determined by an operator of the offset press under trial and error bases by referring the quality of the printing. In a concrete form, the desired value is adjusted in accordance with the quality of the printing done on the printing papers by carrying out following procedures. A desired value is set for temporary purpose, and then printing work is carried out until a volume of the dampening solution supplied to the offset plate becomes a stable condition as shown in FIG. 4. The procedures described in above need to be repeated. As a result, it is required both a certain period of time and printing papers to determine a desired value appropriate for printing in a good condition.

The time and the printing papers consumed during the adjustment occupies a large amount of total resources, especially in a small lot printing carried out recently.

OBJECT AND SUMMARY OF THE INVENTION

It is an object of the present invention to provide a dampening volume control apparatus for offset press capable of shortening a period of time for adjusting a desired value of characteristic which represent a rate of the ink and the dampening solution on a plate surface of the plate at initial phase of the printing work.

In accordance with characteristic of the present invention, a dampening volume control apparatus for offset press comprises:

characteristic measuring means for measuring a characteristic representing a rate of ink and dampening solution on a plate surface of an offset plate, desired value storing means for storing a desired value of the characteristic in an automatic control condition, first control means for outputting a supply signal in accordance with both the characteristic measured by the characteristic measuring means and the desired value of the characteristic, second control means for outputting a supply signal in accordance with a manual dampening volume inputted by an operator of the apparatus, switch means for switching either the supply signal which outputted by the first control means or the supply signal which outputted by the second control means in accordance with a switching command, dampening solution supply means for supplying dampening solution to the offset plate in accordance with the supply signal outputted by the switch means, and desired value adjusting means for varying the desired value of the characteristic in accordance with a characteristic which is measured by the characteristic measuring means in a condition that the switch means outputting the supply signal outputted by the second control means.

Also, in accordance with characteristic of the present invention, a dampening volume control apparatus for offset press comprises:

a dampening solution supply part for supplying dampening solution to an offset plate in accordance with a supply signal being provided thereto, a characteristic measuring part for measuring a characteristic representing a rate of ink and the dampening solution on a plate surface of the offset plate, a desired value storing part for storing a desired value of the characteristic in an automatic control condition, a controller capable of selecting either to the automatic control condition or to a manual control condition in accordance with a switching command inputted by an operator of the controller, the controller controlling the dampening solution supply means in accordance with both the measured characteristic and the desired value of the characteristic in the automatic control condition, the controller controlling the dampening solution supply means in accordance with a manual dampening volume inputted by the operator in the manual control condition, and an adjusting part for varying the desired value of the characteristic stored in the desired value storing part in accordance with a characteristic measured in the manual control condition.

Further, in accordance with characteristic of the present invention, a method for controlling a dampening volume of dampening solution for an offset press, the offset press controlling the dampening volume to an offset plate in accordance with a desired value of a characteristic and a characteristic being measured in an automatic control condition, the characteristic representing a rate of ink and the dampening solution on a plate surface of the offset plate, the desired value of the characteristic being stored in prior to the control, the improvement comprises:

inputting a manual dampening volume by an operator of the offset press, providing the dampening solution to the offset plate in accordance with the manual dampening volume, measuring the characteristic in a condition being controlled by the manual dampening volume, carrying out the automatic control condition by varying the desired value in accordance with the measured characteristic.

While the novel features of the invention are set forth in a general fashion, both as to organization and content, the present invention will be better understood and appreciated, along with other objects and features thereof, from the following detailed description taken in conjunction with the drawings.

THE BEST MODE OF PREFERRED EMBODIMENT TO CARRY OUT THE PRESENT INVENTION

Figure 1:
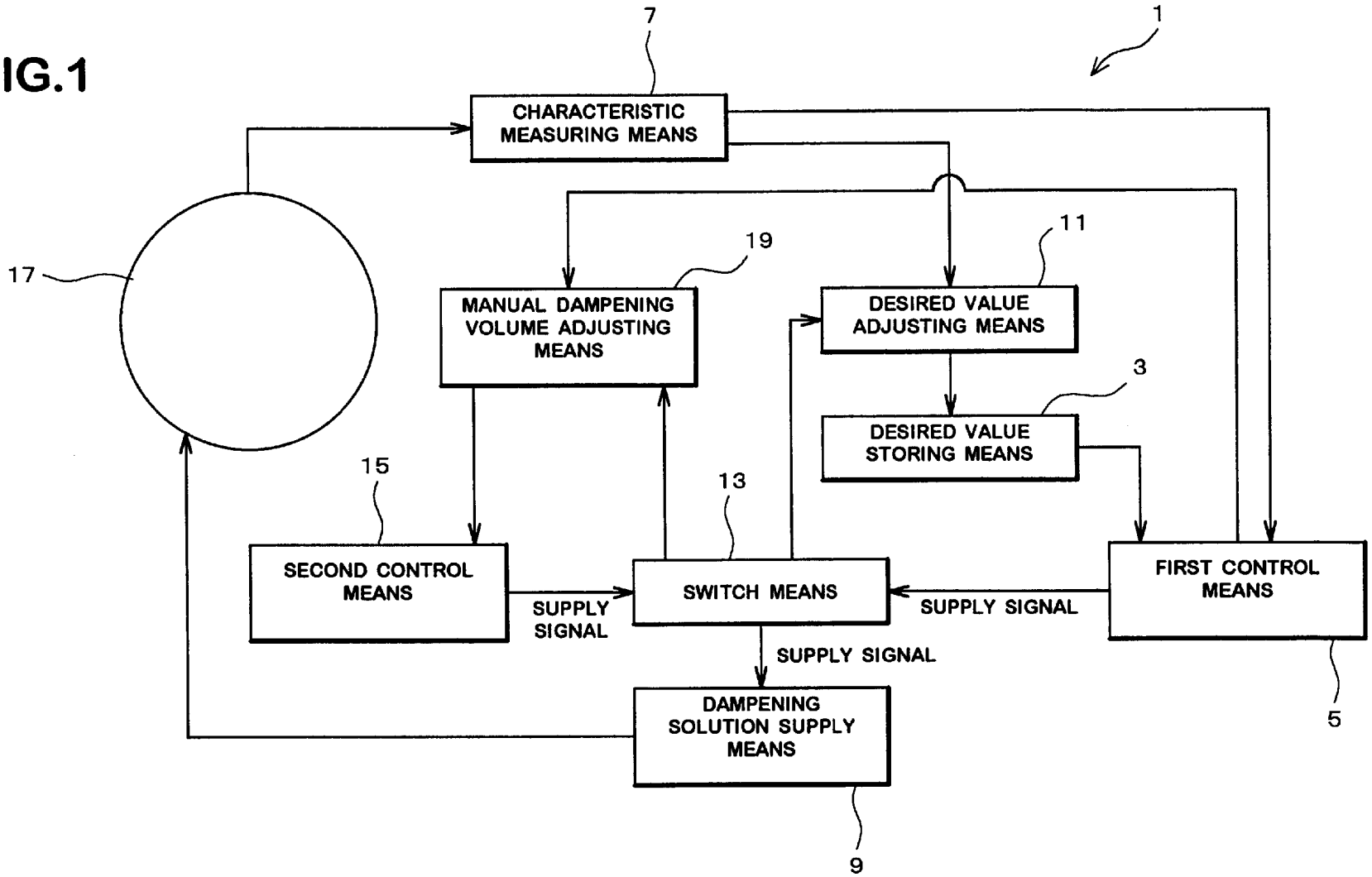
FIG. 1 is a functional block diagram of a dampening volume control apparatus 1 in the present invention.

An embodiment of the present invention is described herein by referring to figures. FIG. 1 is a functional block diagram of a dampening volume control apparatus 1 for an offset press.

The dampening volume control apparatus 1 comprises dampening solution supply means 9, characteristic measuring means 7, desired value storing means 3, first control means 5, second control means 15, switch means 13, desired value adjusting means 11 and a manual dampening volume adjusting means 19.

The characteristic measuring means 7 measures a characteristic which represent a rate of ink and that of the dampening solution on a plate surface of the offset plate 17. The desired value storing means 3 stores a desired value of the characteristic in an automatic control condition. The first control means 5 generates a supply signal in accordance with both a characteristic measured by the characteristic measuring means 7 and the desired value thus stored in the desired value storing means 3. The automatic control condition is a condition that the dampening solution is supplied to the offset plate 17 in accordance with the supply signal generated by the first control means 5.

Also, the second control means 15 generates a supply signal in accordance with a manual dampening volume inputted by an operator of the offset press. A manual control condition is a condition that the dampening solution is supplied to the offset plate 17 in accordance with the supply signal generated by the second control means 15. The manual dampening volume corresponds to the inputted value of the dampening solution. Further, the second control means 15 has means for storing the manual dampening volume which stores the manual dampening volume of the dampening solution thus inputted by the operator.

The switch means 13 switches input of the dampening volume signals provided by the second control means 15 and the first control means 5 to the dampening solution supply means 9 in accordance with a switching command inputted by the operator. The dampening solution supply means 9 supplies dampening solution to the offset plate 17 in accordance with the supply signal.

The desired value adjusting means 11 varies the desired value stored in the desired value storing means 3 in accordance with a characteristic measured in the manual control condition when the switch means 13 is turned so as to connect the first control means 5 with the dampening solution supply means 9.

Further, the manual dampening volume adjusting means 19 varies the manual dampening volume stored in the manual dampening volume storing means to another dampening volume determined by the first control means 5 in accordance with a characteristic measured in the automatic control condition when the switch means 13 is turned so as to connect the second control means 15 with the dampening solution supply means 9.

Details of the control in the automatic control condition and the manual control condition are described herein. The operator switches the switch means 13 to the manual control condition. The dampening solution is supplied to the offset plate by the dampening solution supply means 9 in accordance with the dampening volume inputted by the operator during the manual control condition. The operator inspects quality of printing done on the printed papers. The switch means 13 is turned to the automatic control condition when the quality of the printing done on the printed papers is qualified for the criteria of the printing. The characteristic measuring means 7 measures the characteristic which represents the rate of the ink and that of the dampening solution on the plate surface of the offset plate, and the dampening volume of the dampening solution used for the previous printing work is stored in the desired value storing means 3 as a desired value for upcoming printing work by the switching. Then, the first control means 5 provides the dampening volume signal to the dampening solution supply means 9 so as to coincide the characteristic measured by the characteristics measuring means 7 with the desired value thus stored.

In this way, it is possible for the dampening volume control apparatus 1 to shorten a period of time for adjusting the desired value of characteristic which represents the rate of the ink and that of the dampening solution on the plate surface of the offset plate at the initial phase of the printing work.

Also, the manual dampening volume is varied to the dampening volume determined by the first control means 5 in accordance with the characteristic measured during the automatic control condition when the switch means 13 is turned to the manual control condition. As a result, the manual control condition can be started with an adequate dampening volume even when the printing work is restarted.

The characteristic which represents the rate of the ink and that of the dampening solution on the plate surface of the offset plate is considered as data for controlling the dampening volume for printing in a good condition, and the characteristic includes moisture content of ink rollers, revolution speed of a water fountain roller as well as aqua film thickness itself formed on non-image areas of the offset plate as described in this embodiment.

Figure 2:
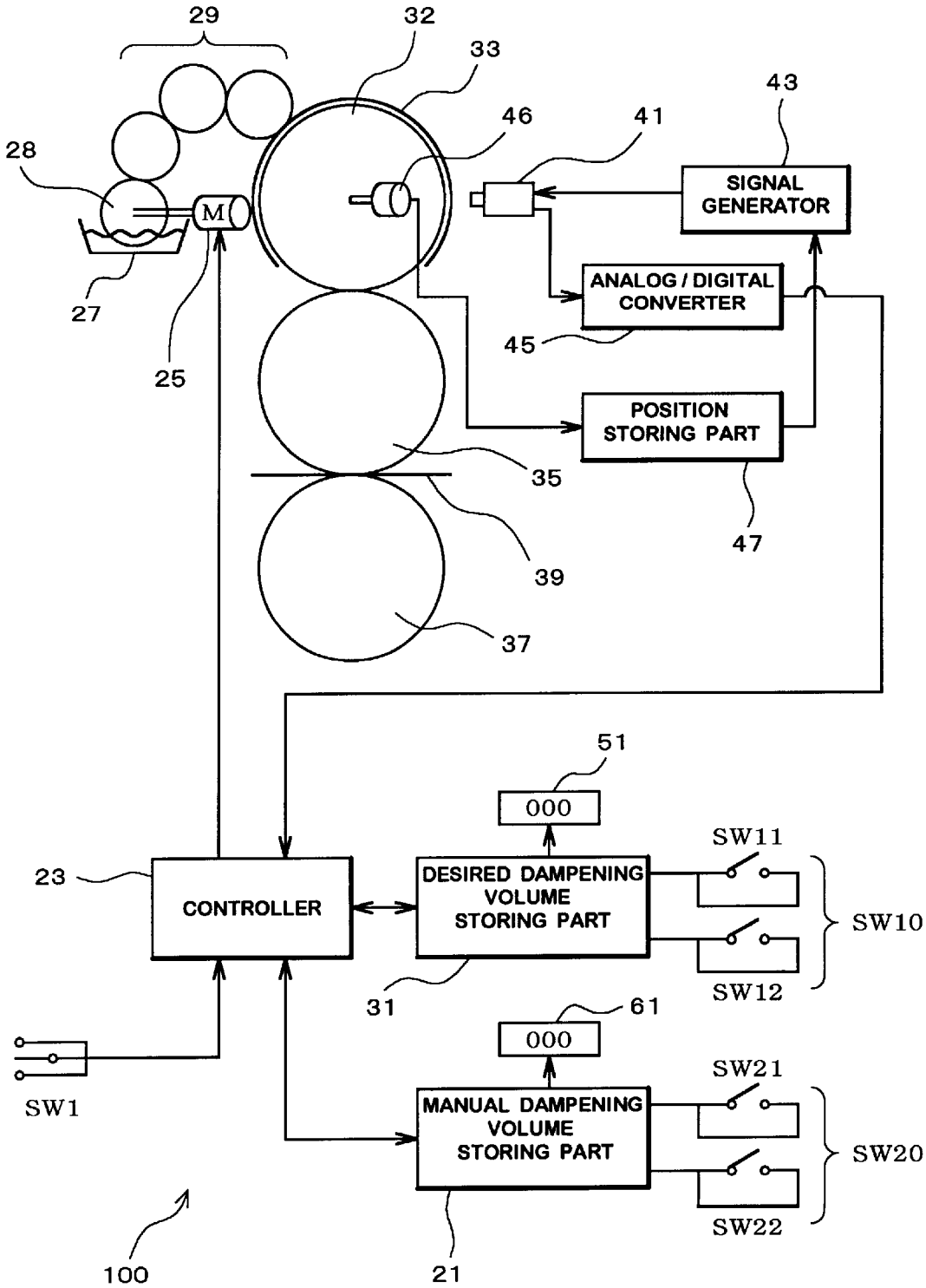
FIG. 2 is a block diagram showing hardware structure of a dampening volume control apparatus 100.
Figure 3:
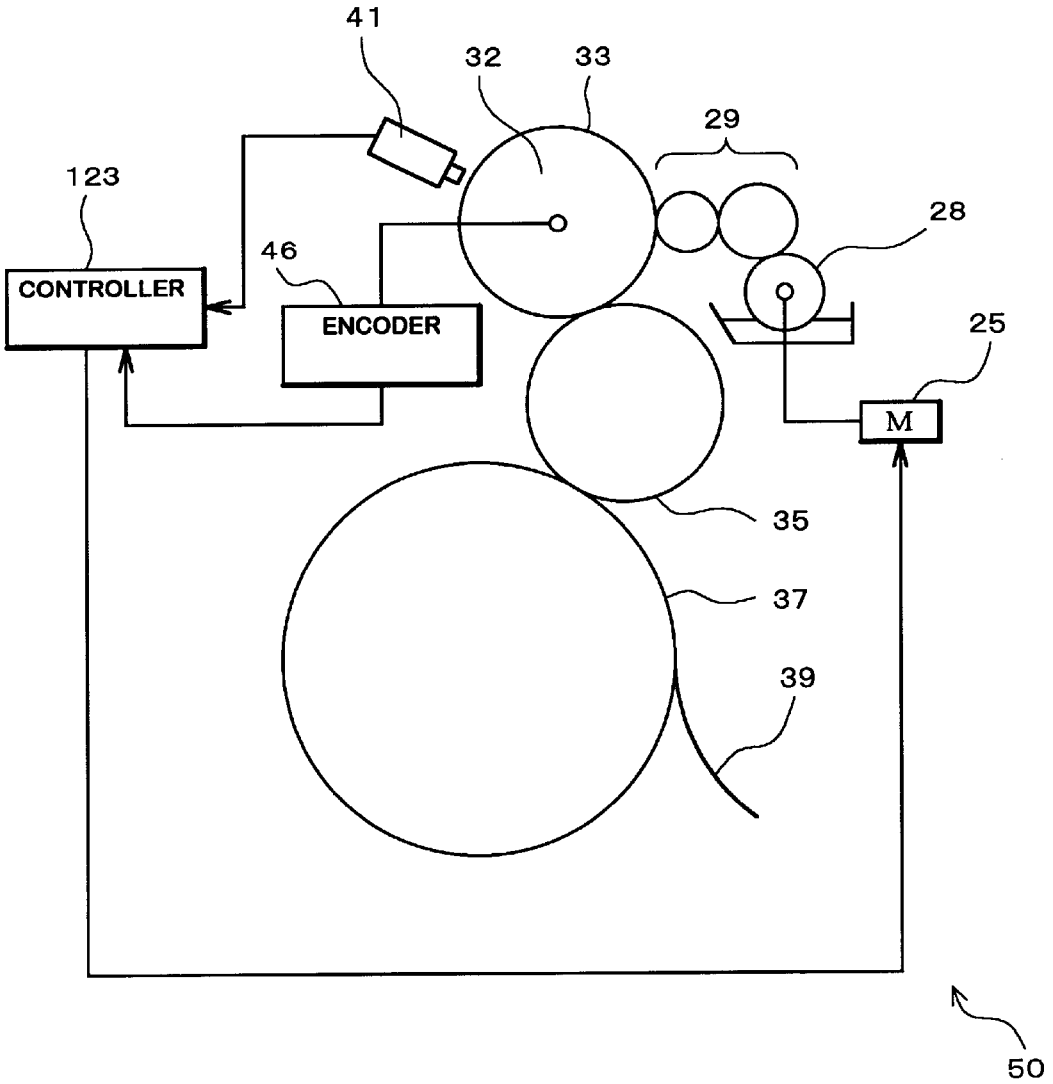
FIG. 3 is a conceptual view of a conventional dampening volume control apparatus.
Figure 4:
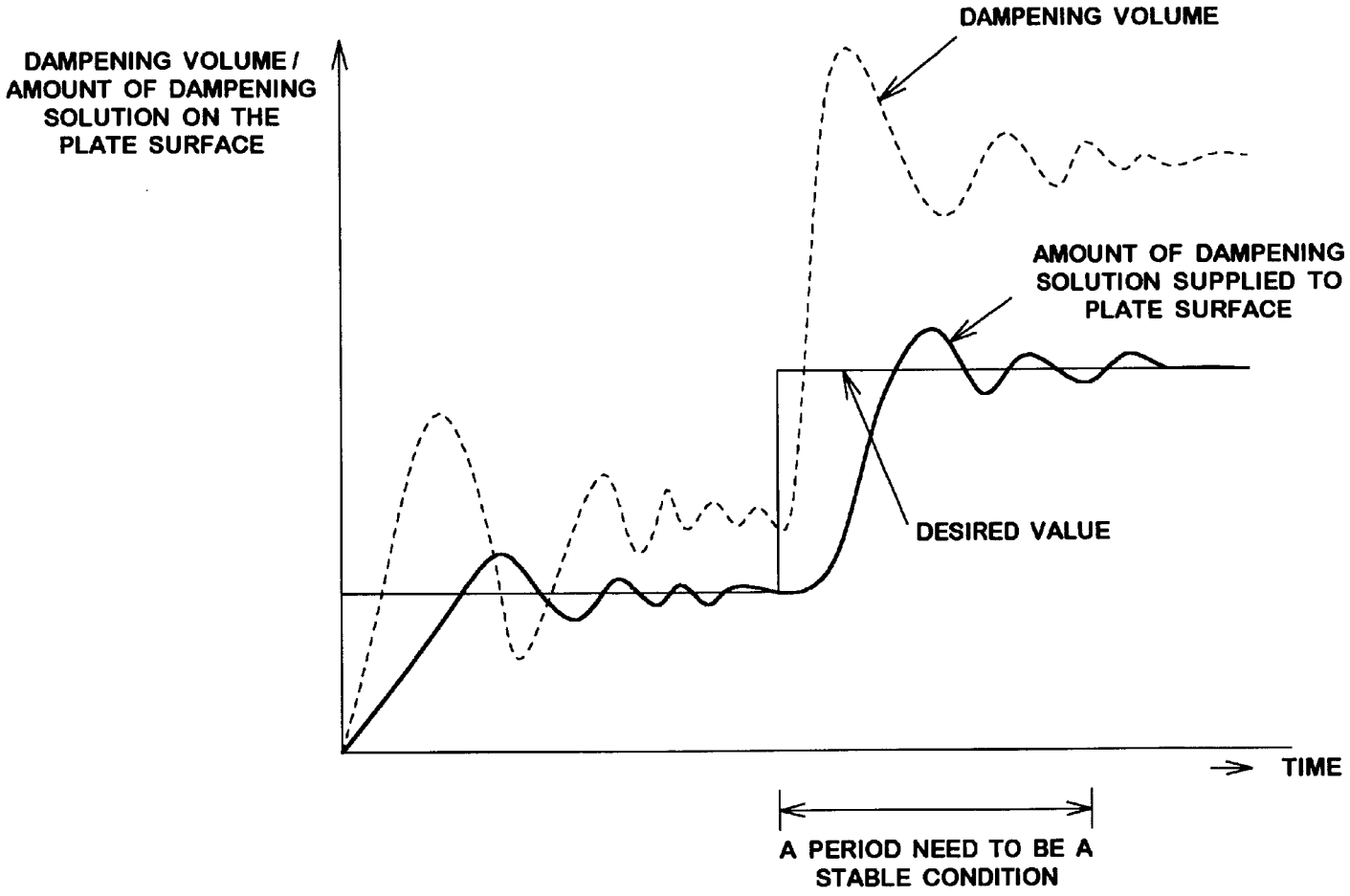
FIG. 4 is a graph for describing a relationship among variation of a volume of the dampening solution supplied to the offset press, a volume of the dampening solution supplied to the plate surface and the desired value of dampening volume.

Next, hardware structure of the dampening volume control apparatus in the present invention is described herein referring to FIG. 2. Dampening volume control apparatus 100 comprises a desired dampening volume storing part 31, a manual dampening volume storing means 21, a controller 23, a switch SW1, a motor 25, a water fountain 27, a water fountain roller 28, dampening rollers 29, a dampening volume sensor 41, a signal generator 43, an analog/digital converter (A/D converter) 45 and a position storing part 47. A desired dampening volume is stored in the desired dampening volume storing part 31 by adjusting a switch SW11 and/or another switch SW12 both of which composing a switch SW10. The desired dampening volume thus stored is displayed on a display 51. Similarly, a manual dampening volume is stored in the manual dampening volume storing means 21 by adjusting a switch SW21 and/or another switch SW22 both of which composing a switch SW20, and the manual dampening volume thus stored is displayed on a display 61. Both the switch SW11 and the switch SW21 are used for increasing the value of input, and the switch SW12 and the switch SW22 are used for decreasing the value of input.

Also, the switch SW1 is a switch used for switching the controller 23 either in an automatic control mode or a manual control mode.

A dampening volume on the non-image areas of the offset plate 33 is detected by the dampening volume sensor 41. In a concrete form, a signal output command is provided to the signal generator 43 when a position detected by an encoder 46 is in agreement with a position stored by the position storing part 47. As a result, aqua film thus formed on the position at the offset plate 33 is detected. The detected dampening volume is converted into digital data by the A/D converter 45, then the digital data are provided to the controller 23.

The controller 23 compares the detected dampening volume with the desired dampening volume stored in the desired dampening volume storing part 31 when the switch SW1 is turned to the automatic control mode. Further, PID (proportional integral derivation) control is carried out by the controller 23 in accordance with a result of the comparison, and a signal for compensating the control is provided to the motor 25. The dampening solution held on the water fountain 27 is conveyed to the offset plate 33 through the dampening rollers 29 by rotating the water fountain roller 28 with the motor 25 in accordance with signals outputted by the controller 23. The dampening solution conveyed to the offset plate 33 is provided to a blanket cylinder 35 together with the ink. So that, printing is carried out on printing papers 39 interposed between the blanket cylinder 35 and an impression cylinder 37 with a certain pressure.

A dampening volume on the offset plate 33 is detected by the dampening volume sensor 41 and the detected volume is provided to the controller 23. The controller 23 compares the detected dampening volume with a desired dampening volume once again. Then, another PID control is carried out by the controller 23 in accordance with a result of the comparison, and another signal for the compensation is provided to the motor 25. Thus, the aqua film formed on the offset plate 33 is maintained in a certain thickness so as to correspond to the desired dampening volume stored in the desired dampening volume storing part 31 by carrying out feedback control during the automatic control mode.

Revolution speed of the motor 25 is controlled by the controller 23 in accordance with the manual dampening volume stored in the manual dampening volume storing means 21 when the switch SW1 is turned to the manual control mode.

Next, storing of the desired value under the manual control mode is described herein. The dampening volume is stored in the manual dampening volume storing means 21 by adjusting the switch SW21 and/or the switch SW22 after turning the switch SW1 to the manual control mode. The dampening volume thus stored is displayed on the display 61.

The dampening solution stored within the water fountain 27 is conveyed to the offset plate 33 through the water fountain roller 28 and the dampening rollers 29 by providing a signal outputted by the controller 23 to the motor 25. The outputted signal corresponds to the dampening volume stored in the manual dampening volume storing means 21.

The dampening volume stored in the manual dampening volume storing means 21 is varied by adjusting the switch SW21 and/or the switch 22 by referring the quality of the printing done on the printing papers 39 by the operator. Revolution speed of the motor 25 is controlled by the controller 23 when the dampening volume stored in the manual dampening volume storing means 21 is varied. The switch SW1 is turned to the automatic control mode when the operator judges that the quality of the printing done on the printed papers is qualified for the criteria of the printing. A dampening volume at the position of the offset plate 33 is also detected by the dampening volume sensor 41 in accordance with the signal generated by the signal generator 43 even in the manual control mode.

The controller 23 controls the dampening volume under the automatic control mode when the switch SW1 is turned to the automatic control mode. In a concrete form, the data stored in the desired dampening volume storing part 31 are updated to another dampening volume detected with the dampening volume sensor 41 as a desired value at a time when the switch SW1 is turned to the automatic control mode. As a result of updating, the desired value stored in the desired dampening volume storing part 31 is set to the dampening volume at the time of turning the switch SW1 to the automatic control mode. The controller 23 reads out the desired value stored in the desired dampening volume storing part 31, and controls the revolution speed of the motor 25 to a speed capable of realizing the desired value thus read out. In other words, the revolution speed of the motor 25 is controlled so as to provide the dampening volume to the offset plate 33 at a time when the quality of the printing done on the printed papers is qualified for the criteria.

Thus, the desired value can be set quicker than ever by controlling the revolution speed of the motor 25 to a speed capable of realizing the desired value stored in the desired dampening volume storing part 31 after storing the desired value at the time when the quality of the printing done on the printed papers is qualified for the criteria as a result of controlling the revolution speed of the motor 25 under the manual control mode at the initial phase of the printing work.

In the embodiment described herein, the data stored in the manual dampening volume storing means 21 are updated by the controller 23 to another dampening volume corresponding to the revolution speed outputted by the controller 23 to the motor 25 when the switch SW1 is turned to the automatic control mode in case of completing the automatic control condition. In this way, the dampening volume determined at the previous printing makes a period of time required for adjusting the appropriate dampening volume shorten even when another plate is used instead of the plate used in the previous printing work. The reason of shortening the time is described as below. Revolution speed of the motor 25 is controlled by the controller 23 so as to make the dampening volume on the plate surface coincide with the volume corresponding to the desired value during the automatic control condition. In general, conditions of printing such as variation of humidity and that of temperature or adherence of the ink to the dampening rollers are changed after carrying out the printing for hours. Revolution speed of the motor 25 is controlled so as to make the dampening volume coincide with the dampening volume corresponding to the desired value even when the printing conditions have been changed. Thus, the printing can be done with appropriate quality under automatic bases once the desired value is set even when the printing conditions have been changed.

Meanwhile, another appropriate dampening volume need to be determined by carrying out the manual control when another plate is used instead of the plate used in the previous printing work. Here, some factors having great influence to determine the dampening volume are the conditions of printing such as room temperature, humidity, adherence of the ink to the dampening rollers and moisture content relative to the ink or the like. It is known that type of the plate and a rate of image area relative to total area of the plate or the like do not have much influence for determining the dampening volume. So that, the printing can be done with a dampening volume nearly adequate by supplying the dampening solution with the dampening volume used in the previous printing work when another plate is used instead of the plate used in the previous printing work because the conditions of the printing have been unchanged.

Although, the switch SW11, the switch SW12, the switch SW21 and the switch SW22 are used for composing both the switch SW10 and the switch SW20 respectively in order to store the desired dampening volumes indirectly in the embodiment described earlier, the desired dampening volumes can also be stored directly by using a ten key or similar apparatus(es).

Further, though feedback control is carried out by the controller 23 in the embodiment described earlier, other control methods suitable for carrying out the control described in above such as neuro control or fuzzy control can be used instead of the feedback control.

Although, the data stored in the desired dampening volume storing part 31 are updated to another dampening volume when the switch SW1 is turned to the automatic control mode from the manual control mode in the embodiment described earlier, the data can be updated at other timing. Similarly, the data stored in the manual dampening volume storing means 21 can be updated at other timing.

The dampening volume control apparatus for offset press in the present invention is characterized in that, the switch means switches input of either the first dampening volume signal provided by the first control means or the second dampening volume signal outputted by the second control means in accordance with a switching command. Also, the second control means outputs a second dampening volume signal to the dampening solution supply means when a dampening volume being supplied to the offset plate in a manual control condition is inputted, the second dampening volume signal corresponding to the dampening volume being inputted. Further, the desired value adjusting means varies the desired value of the characteristic in accordance with a characteristic measured in the manual control condition. So that, the desired dampening volume can be varied directly by using the second control means, so that less period of time is consumed for making the dampening volume in a stable condition unlike to the conventional ones. In this way, it is possible to provide a dampening volume control apparatus for offset press capable of shortening a period of time for adjusting a desired value of characteristics which represent a rate of the ink and the dampening solution on the plate surface of the plate at initial phase of the printing work.

Also, the dampening volume control apparatus for offset press in the present invention is characterized in that, a manual dampening volume being inputted is stored in the second control means, and the manual dampening volume is varied in accordance with the desired value of the characteristic in the automatic control condition. So that, upcoming printing work can be started under the manual control condition at an adequate dampening volume in consideration of conditions of the printing work carried out previously under the automatic control condition.

Further, a method for controlling a dampening volume of dampening solution for offset press in the present invention is characterized in that, the desired value of the characteristic is varied in accordance with a characteristic measured in the manual control condition with switching the offset press to the manual control condition capable of setting a dampening volume to the offset plate. So that, the desired value can be set quickly under the manual control mode at the initial phase of the printing work. In addition, printing work can be continued with a desired value being varied in accordance with a characteristic measured in the manual control condition even when the offset press is switched to the automatic control condition.

Still further, a method for controlling a dampening volume for offset press in the present invention is characterized in that, a manual dampening volume being inputted is stored, and the manual dampening volume is varied in accordance with the desired value of the characteristic in the automatic control condition. So that, upcoming printing work can be started under the manual control condition with an adequate dampening volume in consideration of conditions of the printing work carried out previously under the automatic control condition.

While the invention has been described in its preferred embodiments, it is to be understood that the words which have been used and words of description rather than limitation and that changes within the purview of the appended claims may be made without departing from the true scope and spirit of the invention in its broader aspects.

What is claimed is:

1. A dampening volume control apparatus for offset press comprising:

characteristic measuring means for measuring a characteristic representing a rate of ink and dampening solution on a plate surface of an offset plate, desired value storing means for storing a desired value of the characteristic in an automatic control condition, first control means for outputting a supply signal in accordance with both the characteristic measured by the characteristic measuring means and the desired value of the characteristic, second control means for outputting a supply signal in accordance with a manual dampening volume inputted by an operator of the apparatus, switch means for switching either the supply signal which is outputted by the first control means or the supply signal which is outputted by the second control means in accordance with a switching command, dampening solution supply means for supplying dampening solution to the offset plate in accordance with the supply signal outputted by the switch means, and desired value adjusting means for varying the desired value of the characteristic in accordance with a characteristic which is measured by the characteristic measuring means in a condition that the switch means outputting the supply signal outputted by the second control means.

2. In a dampening volume control apparatus for offset press in accordance with claim 1, wherein the second control means has means for storing the manual dampening volume inputted by the operator, and wherein the apparatus further comprises means for adjusting the manual dampening volume stored in the manual dampening volume storing means in accordance with the desired value of the characteristic in the automatic control condition.

3. A dampening volume control apparatus for offset press comprising:

a dampening solution supply part for supplying dampening solution to an offset plate in accordance with a supply signal being provided thereto, a characteristic measuring part for measuring a characteristic representing a rate of ink and the dampening solution on a plate surface of the offset plate, a desired value storing part for storing a desired value of the characteristic in an automatic control condition, a controller capable of selecting either to the automatic control condition or to a manual control condition in accordance with a switching command inputted by an operator of the controller, the controller controlling the dampening solution supply means in accordance with both the measured characteristic and the desired value of the characteristic in the automatic control condition, the controller controlling the dampening solution supply means in accordance with a manual dampening volume inputted by the operator in the manual control condition, and an adjusting part for varying the desired value of the characteristic stored in the desired value storing part in accordance with a characteristic measured in the manual control condition.

4. A dampening volume control apparatus for offset press in accordance with claim 3, wherein a manual dampening volume being inputted is stored in the controller, and wherein the manual dampening volume is varied in accordance with the desired value of the characteristic in the automatic control condition.

5. A method for controlling a dampening volume of dampening solution for an offset press, the offset press controlling the dampening volume to an offset plate in accordance with a desired value of a characteristic and a characteristic being measured in an automatic control condition, the characteristic representing a rate of ink and the dampening solution on a plate surface of the offset plate, the desired value of the characteristic being stored in prior to the control, the improvement comprising:

inputting a manual dampening volume by an operator of the offset press, providing the dampening solution to the offset plate in accordance with the manual dampening volume, measuring the characteristic in a condition being controlled by the manual dampening volume, carrying out the automatic control condition by varying the desired value in accordance with the measured characteristic.

6. A method for controlling a dampening volume of dampening solution for an offset press in accordance with claim 5, wherein a manual dampening volume being inputted is stored, and wherein the manual dampening volume is varied in accordance with the desired value of the characteristic used in the automatic control condition.

* * * * *